US008572878B2

(12) United States Patent
Gentilini et al.

(10) Patent No.: US 8,572,878 B2
(45) Date of Patent: Nov. 5, 2013

(54) DE-COCKING MECHANISM FOR STRIKER-FIRED SEMI-AUTOMATIC PISTOLS

(75) Inventors: Claudio Gentilini, Brescia (IT); Jason Kellogg, Crofton, MD (US)

(73) Assignee: Beretta USA Corp., AccoKeek, MD (US)

( * ) Notice: Subject to any disclaimer, the term of this patent is extended or adjusted under 35 U.S.C. 154(b) by 801 days.

(21) Appl. No.: 12/789,551

(22) Filed: May 28, 2010

(65) Prior Publication Data

US 2011/0289811 A1 Dec. 1, 2011

(51) Int. Cl.
*F41A 19/00* (2006.01)

(52) U.S. Cl.
USPC ..... 42/69.01; 42/69.02; 42/70.08; 42/70.04; 89/150; 89/144; 89/27.12

(58) Field of Classification Search
USPC ..... 42/69.01, 69.02, 70.08, 70.04; 89/150, 89/144, 27.12
See application file for complete search history.

(56) References Cited

U.S. PATENT DOCUMENTS

| | | | | |
|---|---|---|---|---|
| 8,122,633 | B2 * | 2/2012 | Kerbrat et al. | 42/20 |
| 8,132,496 | B2 * | 3/2012 | Zukowski | 89/142 |
| 8,371,058 | B2 * | 2/2013 | Trpcic | 42/108 |
| 2010/0077643 | A1 * | 4/2010 | Kerbrat et al. | 42/1.06 |
| 2011/0265639 | A1 * | 11/2011 | Darian | 89/191.01 |

* cited by examiner

*Primary Examiner* — J. Woodow Eldred
(74) *Attorney, Agent, or Firm* — Ladas & Parry LLP

(57) ABSTRACT

A cocking/de-cocking mechanism for semi-automatic striker-fired pistols having a multi-function cocking lever for controlling, by rotational movement, the cocking or arming of the tiring pin, while effecting de-cocking by the lateral displacement of the cocking lever on its support pin.

5 Claims, 15 Drawing Sheets

DE-COCKING MECHANISM FOR STRIKER-FIRED SEMI-AUTOMATIC PISTOLS

FIELD OF THE INVENTION

The present invention is directed to a safety mechanism in the nature of an improved cocking and de-cocking assembly for striker-fired pistols enabling the striker to be de-cocked with ease and speed for safe field stripping of the weapon.

BACKGROUND OF THE INVENTION

Safety mechanisms for pistols have been developed for both hammer-fired and striker-fired semi-automatic weapons to prevent accidental discharge should the weapon fall, be dropped, or otherwise be subject to a sudden application of a stray force. Among the mechanisms developed for this objective are locking or blocking members associated with the trigger and/or firing pin to prevent such accidental discharge. It is to an improved cocking/de-cocking arrangement for striker-fired pistols to which the present invention is specifically directed. The new and improved arrangement permits striker-fired pistols to be simply disassembled without having to pull the trigger, a potentially dangerous condition if ammunition is in the firing chamber, as is the case with earlier de-cocking systems.

OBJECT OF THE PRESENT INVENTION

Striker-fired pistols have been well-developed by the art. Such pistols are absent a traditional hammer and firing pin. They employ a spring-biased striker pin urged into a "cocked" pre-firing condition by a cocking lever actuated by a trigger bar linked to a finger trigger. The striker pin itself is typically pre-cocked by the forward movement of the slide into battery position. The shooter's finger action on the trigger is relieved upon discharge by the striker pin detonating the explosive charge in the ammunition. This simplicity of both operation and design for striker pin fired guns, while making such guns inexpensive to manufacture, can make the pistol vulnerable to mishaps caused by accidental drops of the weapon or rough handling.

Importantly, the striker pin, which is intercepted by the cocking lever during the forward displacement of the slide, must be safely disarmed whenever it is necessary to disassemble the weapon by free relative movement of the slide and the gun barrel. For this purpose, absent the mechanism which is the subject of the invention, the shooter, heretofore, had to pull the trigger in a potentially dangerous "dry firing" of the gun.

The new and improved cocking/de-cocking mechanism has a minimum number of parts and lends itself to manufacture using inexpensive, high volume techniques such as stamping and casting, rather than comparatively expensive machining processes, and utilizing off-the-shelf elements as well. The new trigger bar may be stamped at low cost while the cocking lever may be made at low cost by metal injection molding.

The present invention eliminates this danger attendant with trigger squeezing "dry firing" by providing a simple, safe, and very inexpensive cocking/de-cocking arrangement predicated upon the actions of a specially configured multiple tasking cocking lever, specially configured trigger bar, in cooperation with the slide, frame, and receiver. For a full understanding and appreciation of the new de-cocking mechanism, reference should be made to the following detailed description of the invention taken in conjunction with the accompanying drawings illustrating the mechanism and principles of the invention.

DETAILED DESCRIPTION OF THE INVENTION

Figure 1:
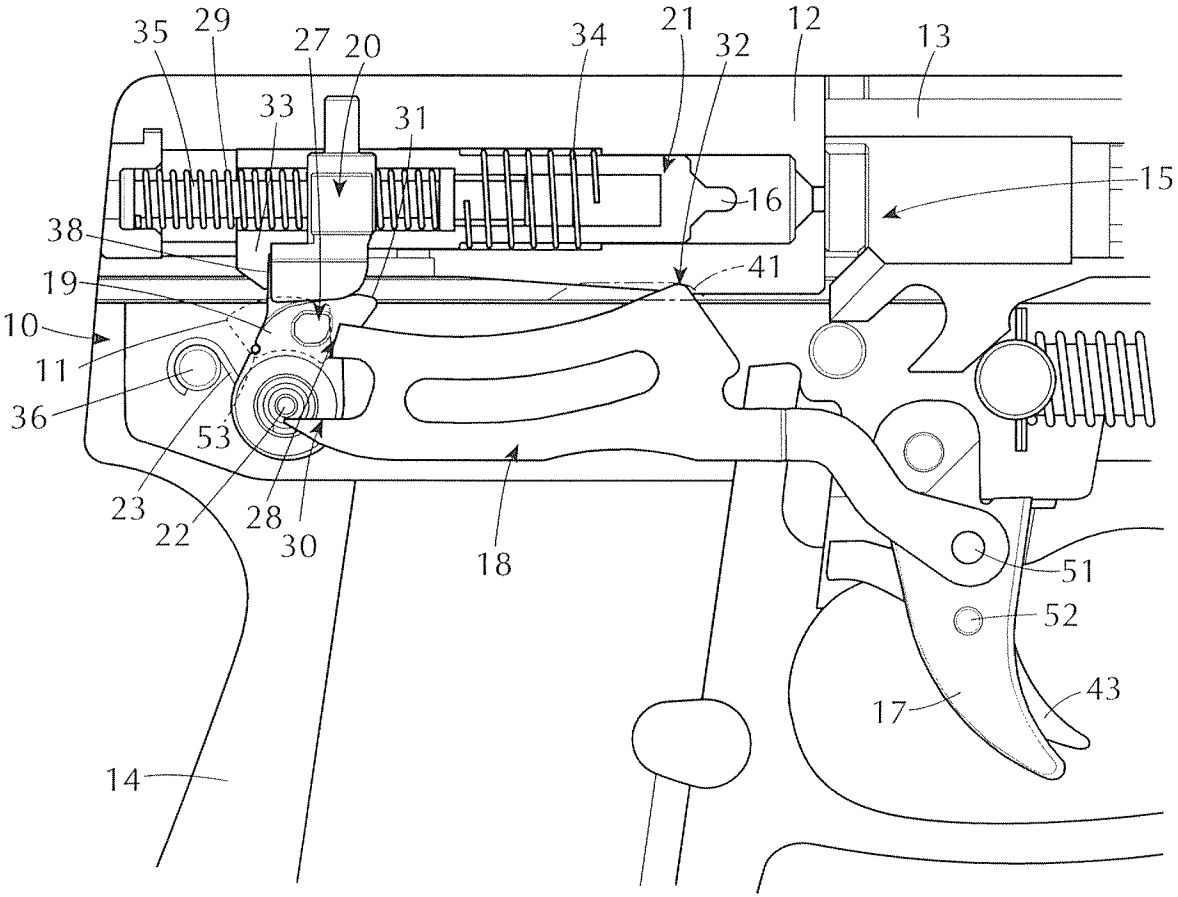
FIG. 1 is a cross-sectional view of the rear end of a striker-fired semi-automatic pistol incorporating the new cocking lever arrangement with the striker pin in a pre-cocked position and the striker blocked by the safety block, and the trigger in its initial position.
Figure 2:
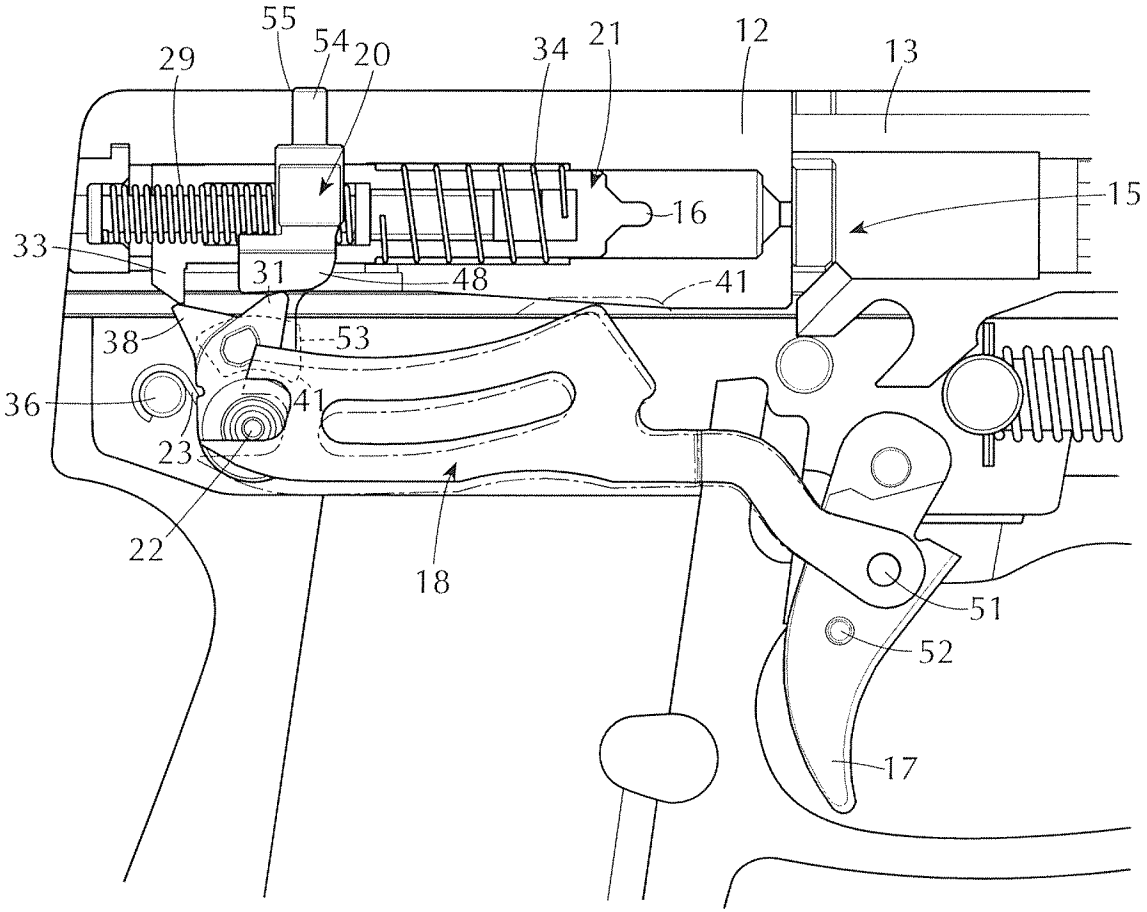
FIG. 2 is a cross-sectional view of the new pistol showing the trigger bar engaging the cocking lever, with the striker unblocked by the elevation of the safety block.
Figure 3:
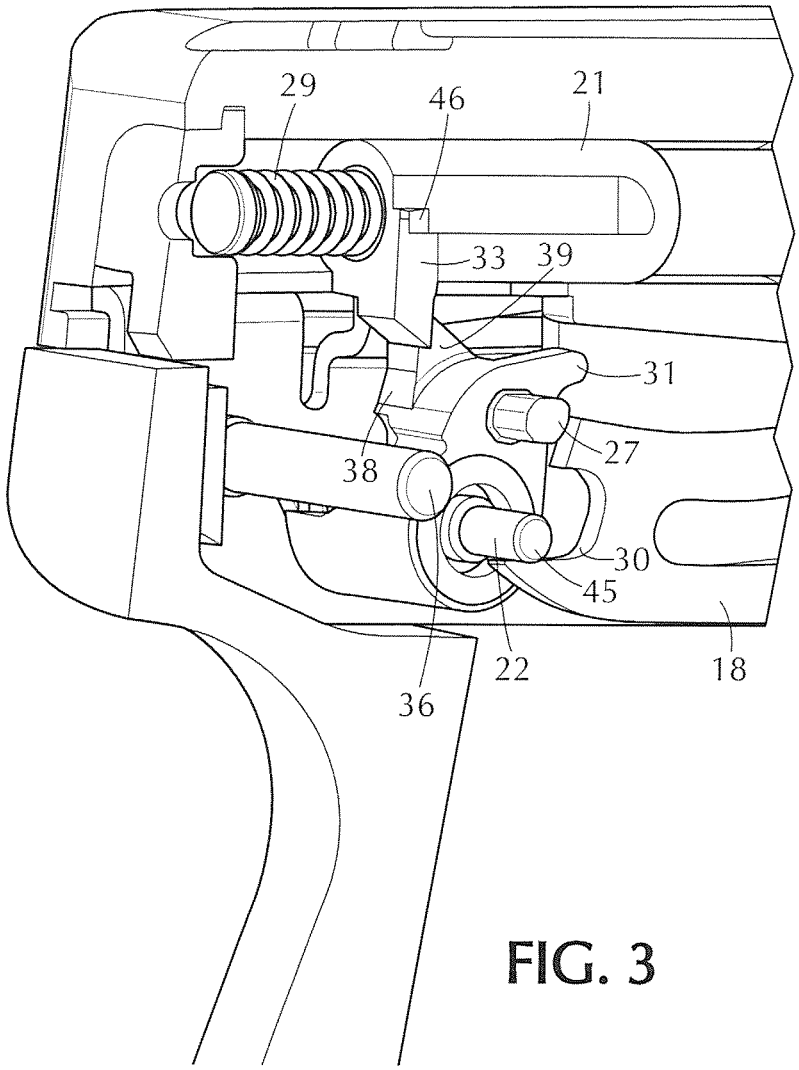
FIG. 3 is a perspective view of the non-elevated safety block and blocked striker.

As shown in FIGS. 1 and 2, the pistol body of the present invention, of generally conventional semi-automatic pistol construction, includes a frame 10 (advantageously of plastic to reduce the overall weight) in which a receiver 11 is mounted. A reciprocating slide 12 and gun barrel 13 are supported on the frame in conventional manner. A spring loaded magazine (not shown) containing ammunition may be inserted in the hollow pistol grip 14 to supply bullets sequentially to the firing chamber 15 in known fashion with each reciprocation of the slide 12. The gun is fired by actuating the striker pin 16 through a new and improved cocking/de-cocking mechanism incorporated into a fundamental striker-pin fired semi-automatic pistol, and including a trigger 17 biased by trigger spring 44, trigger bar 18, multi-purpose cocking lever 19, striker safety block 20, and de-cocking pin 22 which supports the cocking lever.

Figure 6:
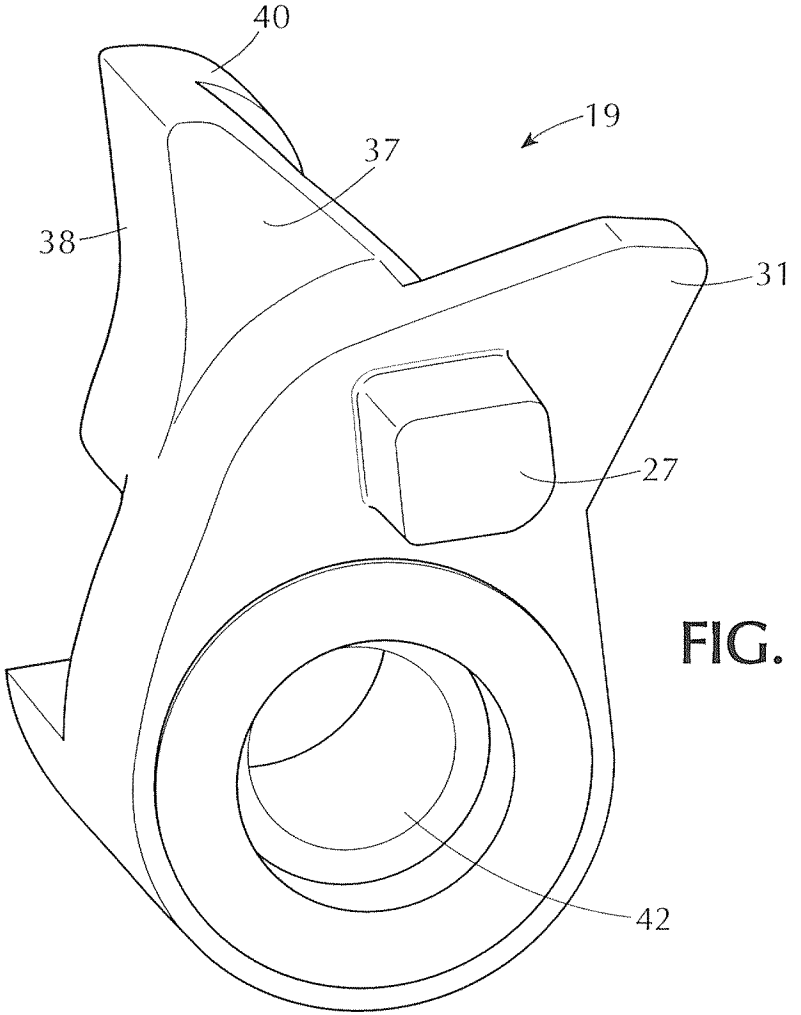
FIG. 6 is a perspective view of the new cocking lever.
Figure 7:
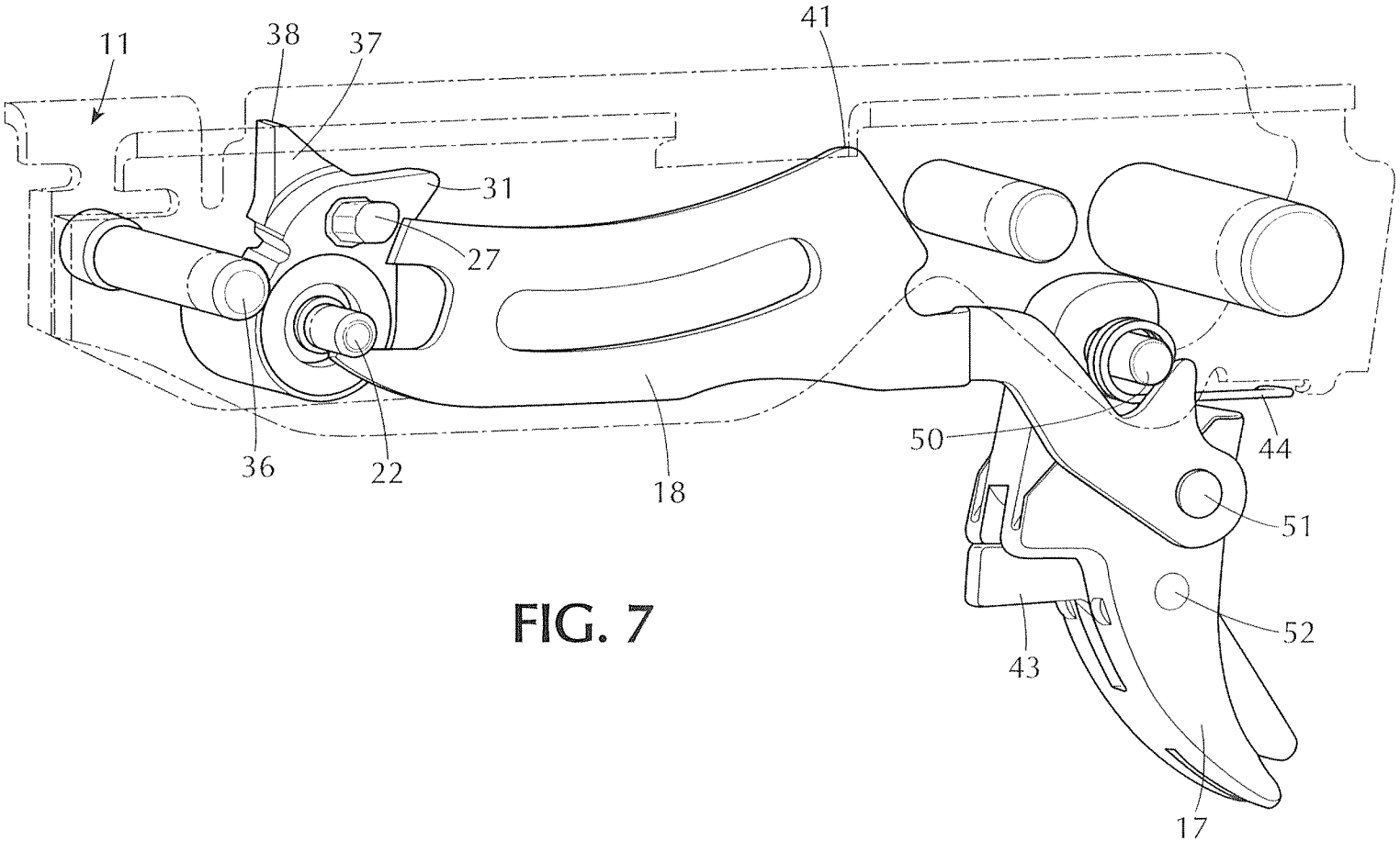
FIG. 7 is a perspective view of the receiver with the cocking lever and trigger bar.
Figure 8:
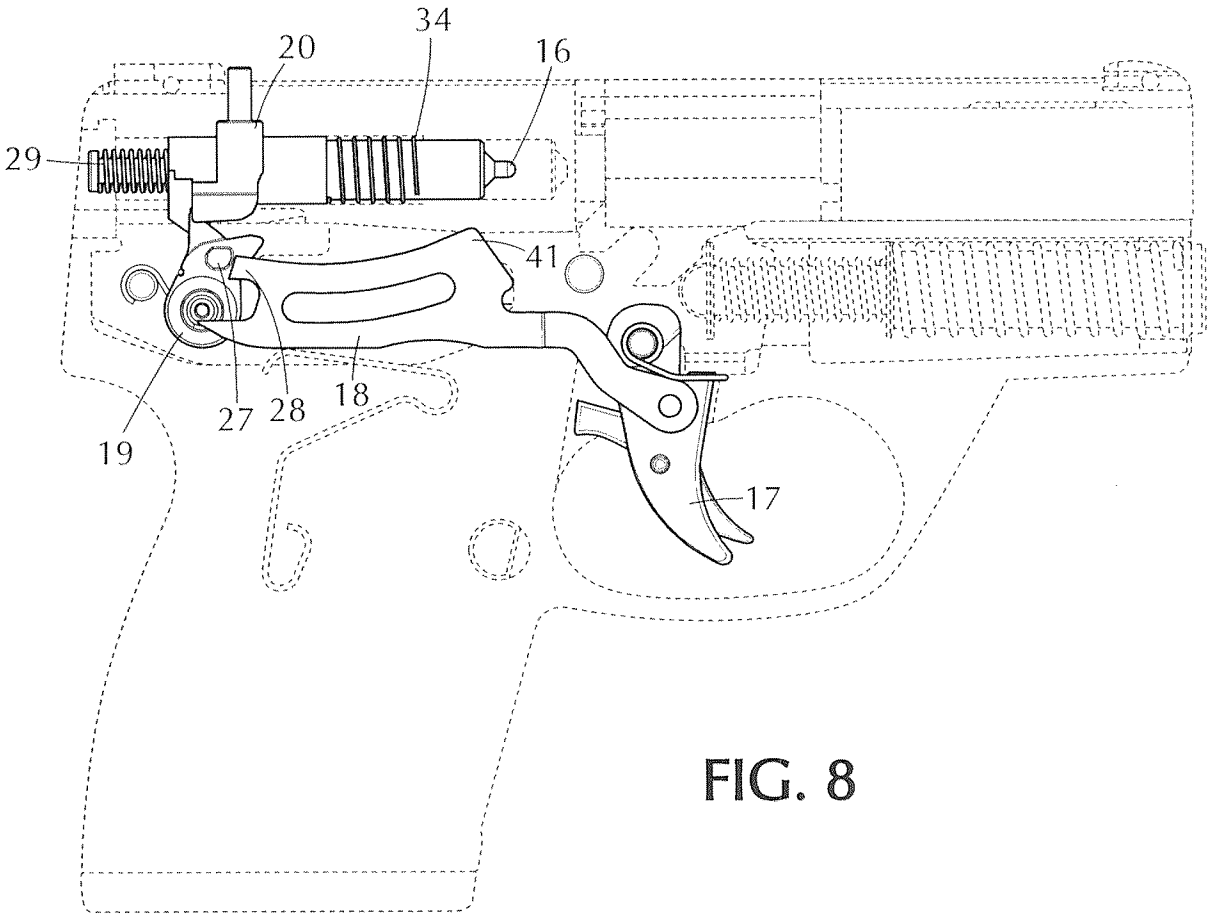
FIG. 8 is a side elevational view of the elements of the cocking lever sub-assembly in the "pre-cock" or "at rest" stage.

The pistol frame 10 (advantageously of molded plastic construction) encloses the metal receiver 11 in which the new cocking lever 19 (FIG. 6), cocking lever spring 23, de-cocking pin 22 and retaining ring 24 are mounted. The receiver has an aperture 53 through which cocking lever lug 27 projects laterally (FIGS. 1, 2). These parts are assembled in the receiver 11 as follows:

First the multi-purpose cocking lever 19 and its associated biasing spring 23 are inserted and the de-cocking pin 22 inserted to support the cocking lever 19 on its bore 42, then the retaining ring 24 is inserted in an associated groove. The spring 23 is constrained at one end on the cocking lever 19 and at the other end on the receiver 11. The cocking lever 19 has a right (as viewed from the rear of the gun) lobe 31, and left lobe 37 with surfaces 38, 40, and a lug 27.

Figure 4:
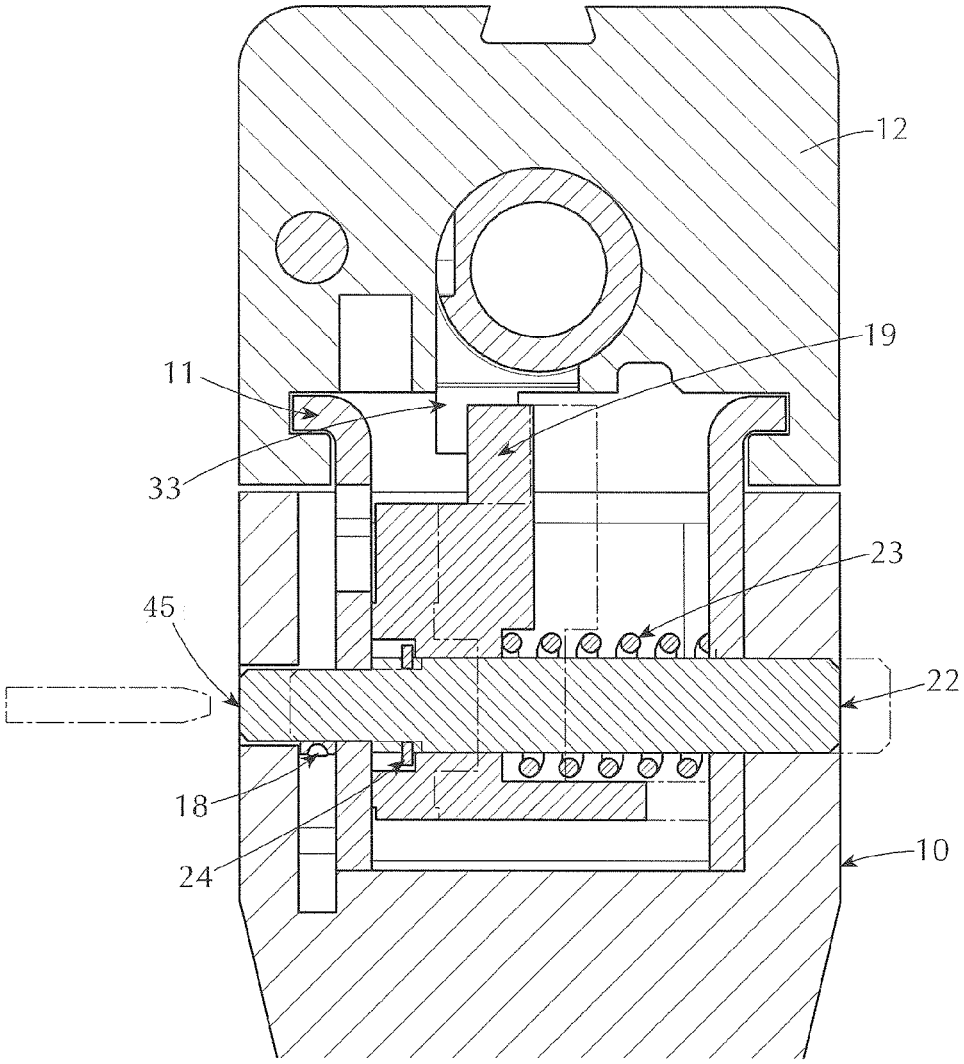
FIG. 4 is a vertical cross-sectional view of the new cocking/de-cocking arrangement seen from the muzzle and taken through the cocking lever sub-assembly.
Figure 5:
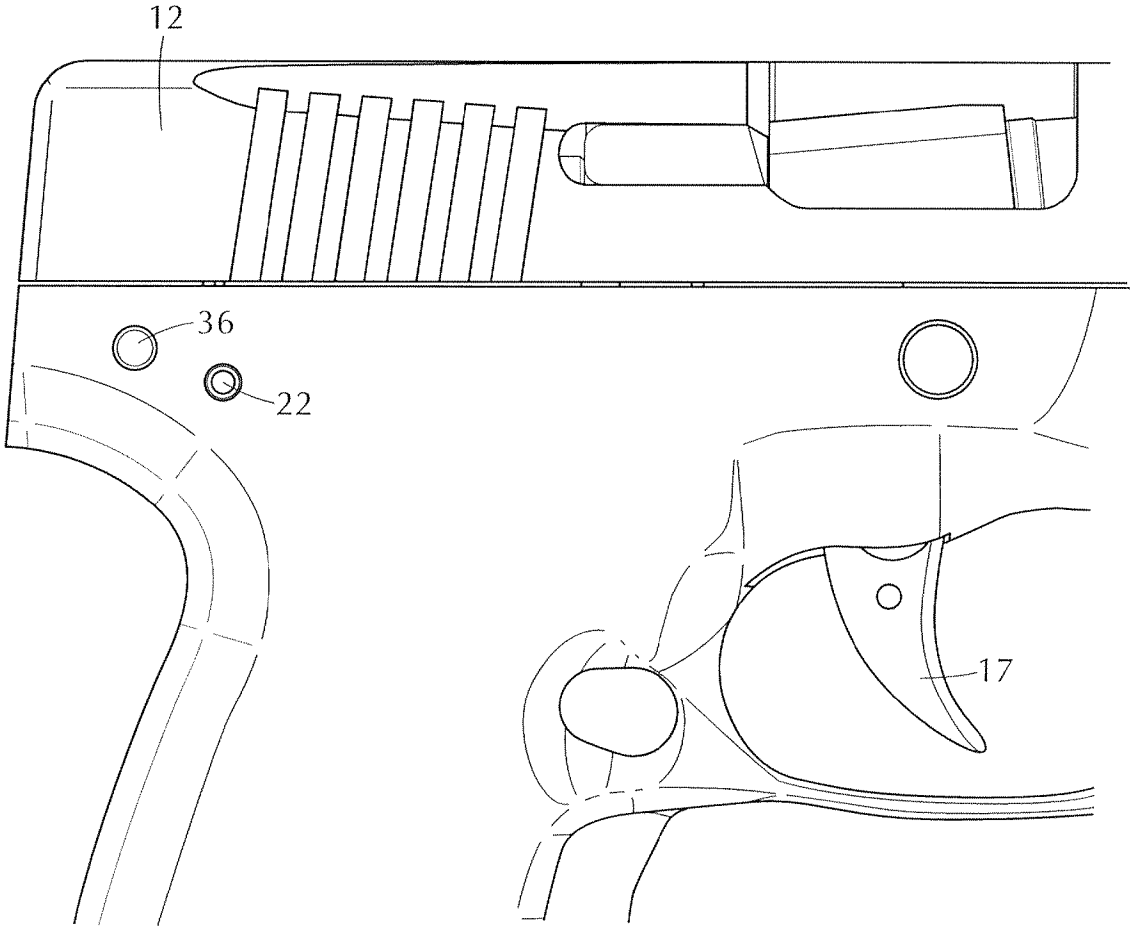
FIG. 5 is a side elevational view of the rear end of the pistol with the cocking lever pin visible and accessible for de-cocking by insertion of a de-cocking tool for transverse displacement of the cocking lever pin.

In accordance with the invention, the cocking lever 19, in this advantageous arrangement, possesses two distinct degrees of freedom: (1) rotation for moving the striker 21 rearward by lobe surface 38 until disengagement, and (2) the lateral translation within the receiver (dashed line position, FIG. 4) by displacement of the de-cocking pin 22.

The return in position of the multi-function cocking lever 19 from either one of its rotational or lateral movements is provided by the action of cocking lever spring 23 designed to function both in torsion and compression. The new assembly achieves multiple separate functions of the cocking lever, rotation for cocking and linear axial translation for de-cocking. In accordance with the invention, axial translation of the lever 19 is achieved by pushing the concavely recessed right end 45 of the pin 22 inwardly with a simple tool such as a punch key (phantom) to effect the de-cocking function. It is important to note that the de-cocking operation is absolutely safe, since the striker will stop against the safety block 20, thus prohibiting travel forward into the cartridge primer. Further safety is ensured by the reduced energy of the relaxed striker spring 29 at de-cocking (pre-cock position), which is insufficient to contact and to ignite the primer.

Figure 10:
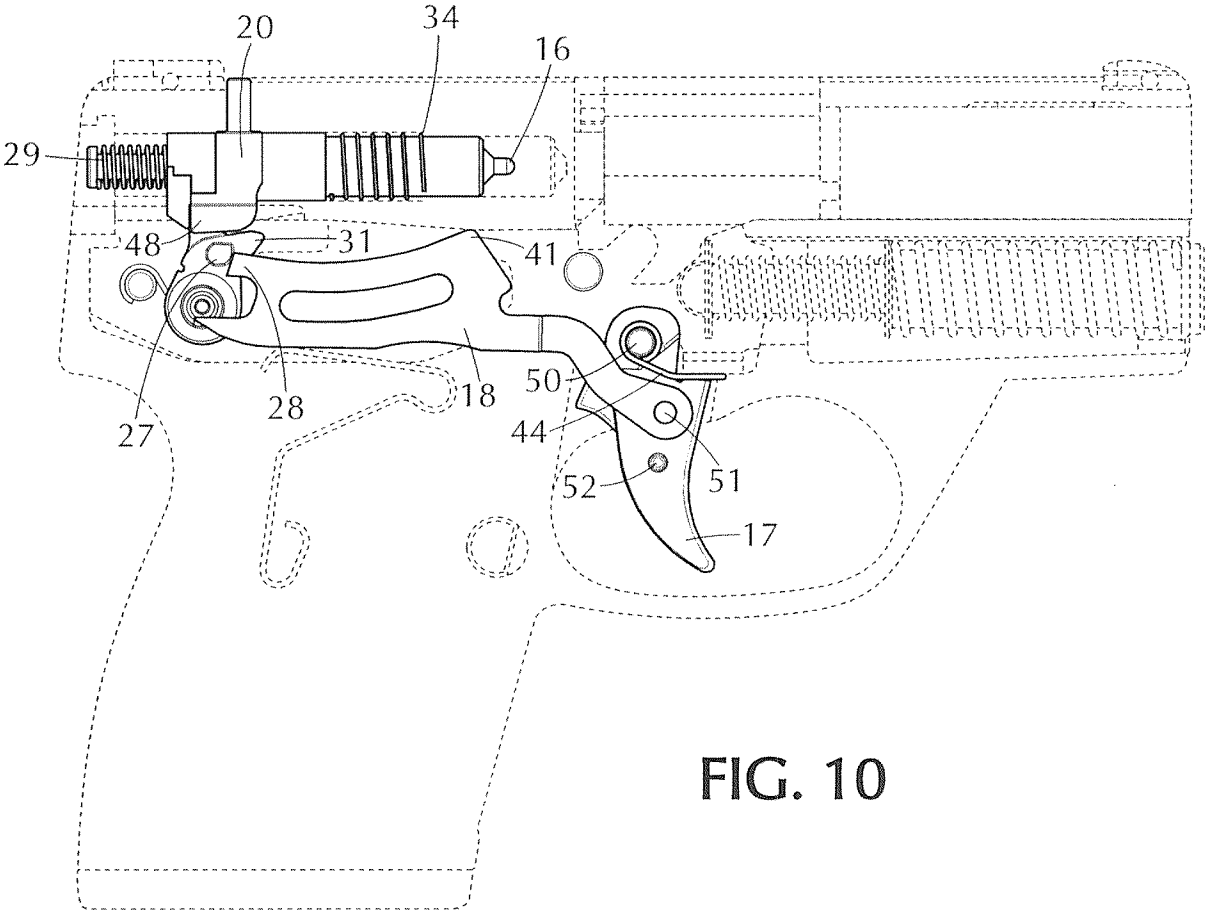
FIG. 10 is a perspective view of the elements of the cocking lever sub-assembly at the beginning of "armament;"
Figure 11:
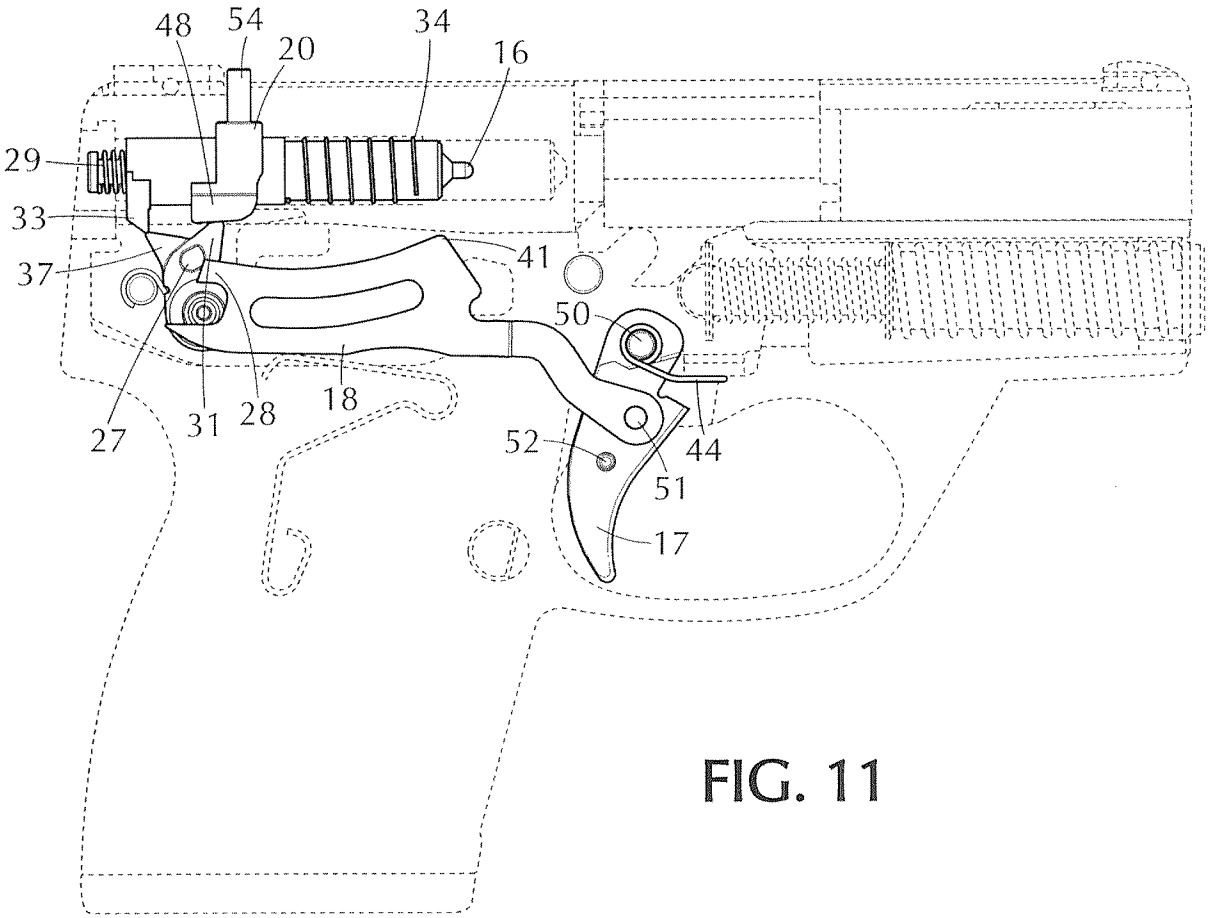
FIG. 11 is a perspective view of the elements of the cocking lever sub-assembly at the end of "armament;"
Figure 12:
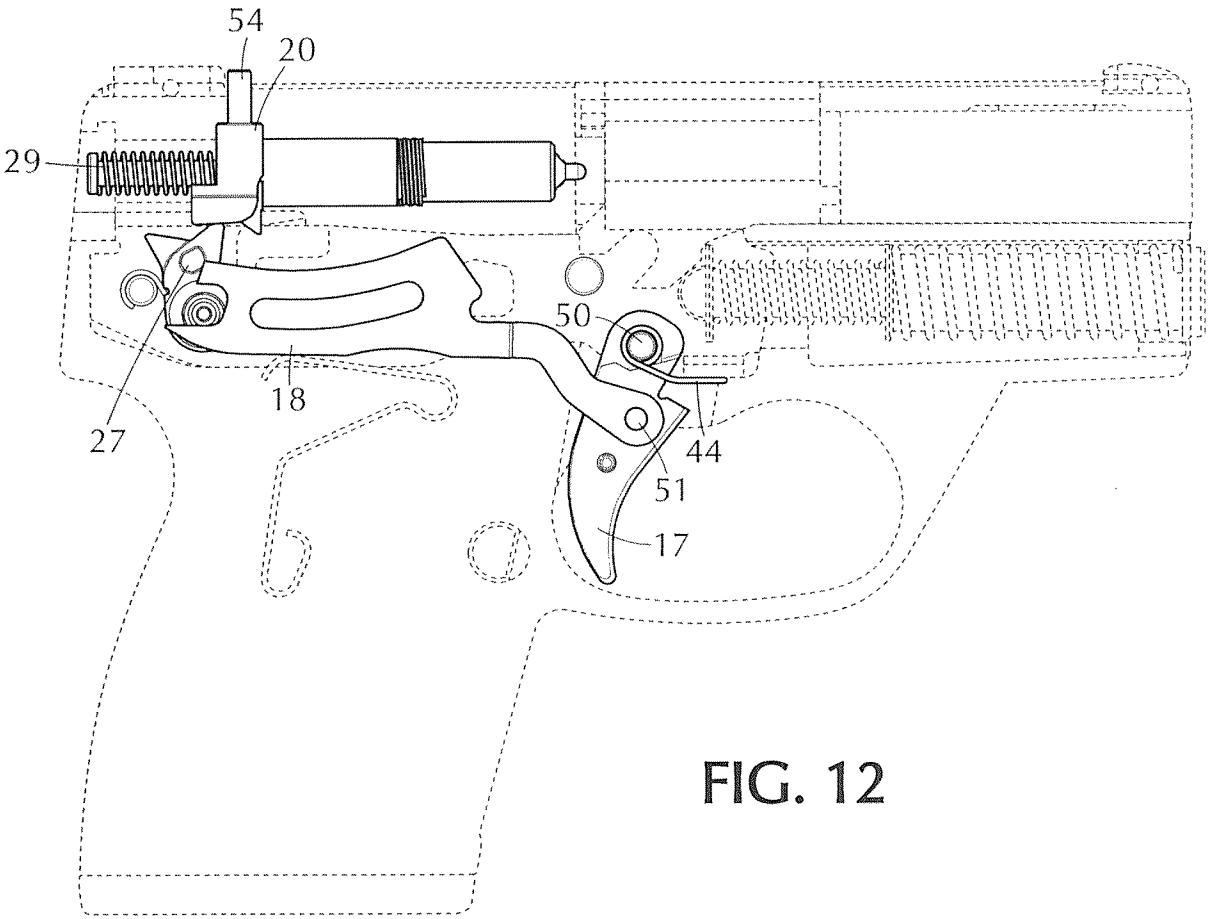
FIG. 12 is a perspective view of the elements of the cocking lever sub-assembly at "firing;"
Figure 13:
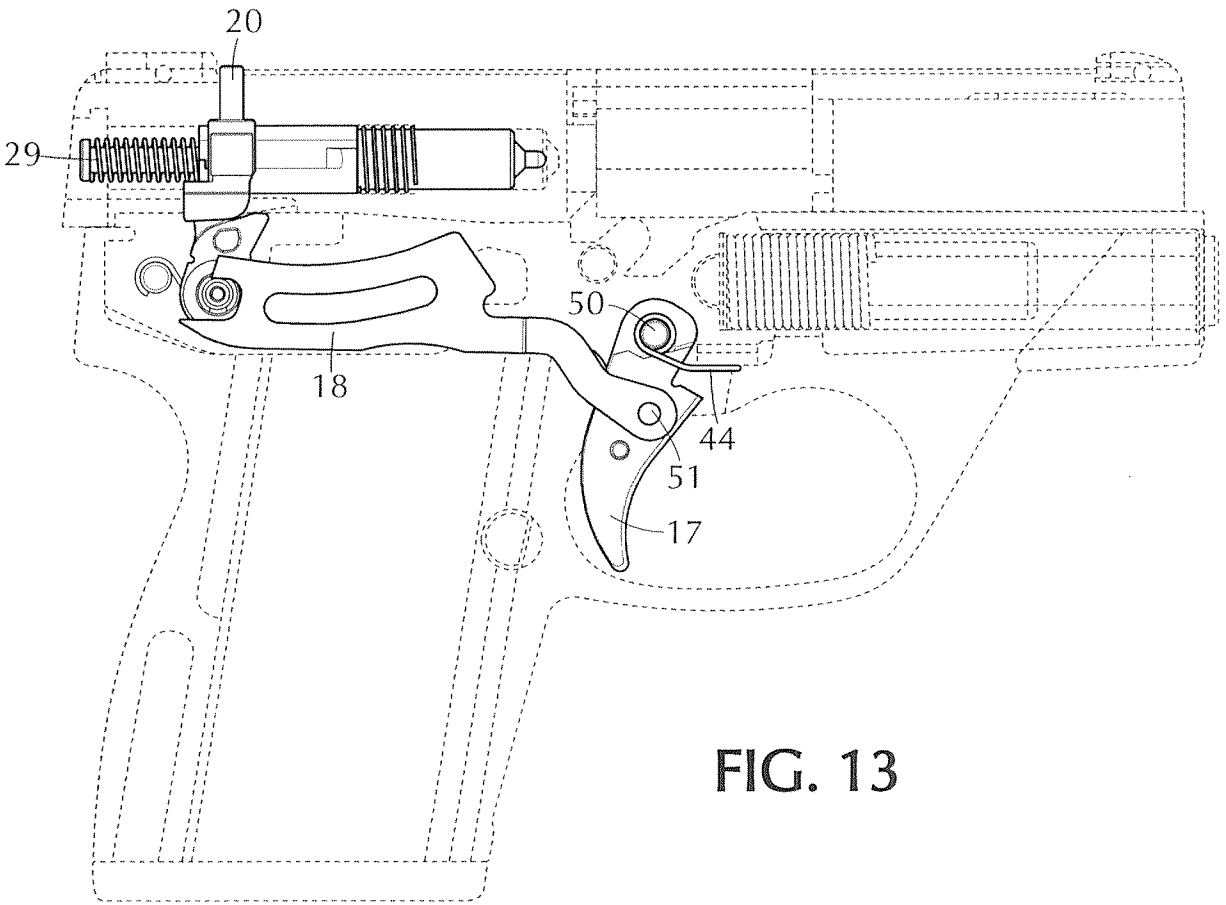
FIG. 13 is a perspective view of the elements of the cocking lever sub-assembly at the beginning of "recoil;"
Figure 14:
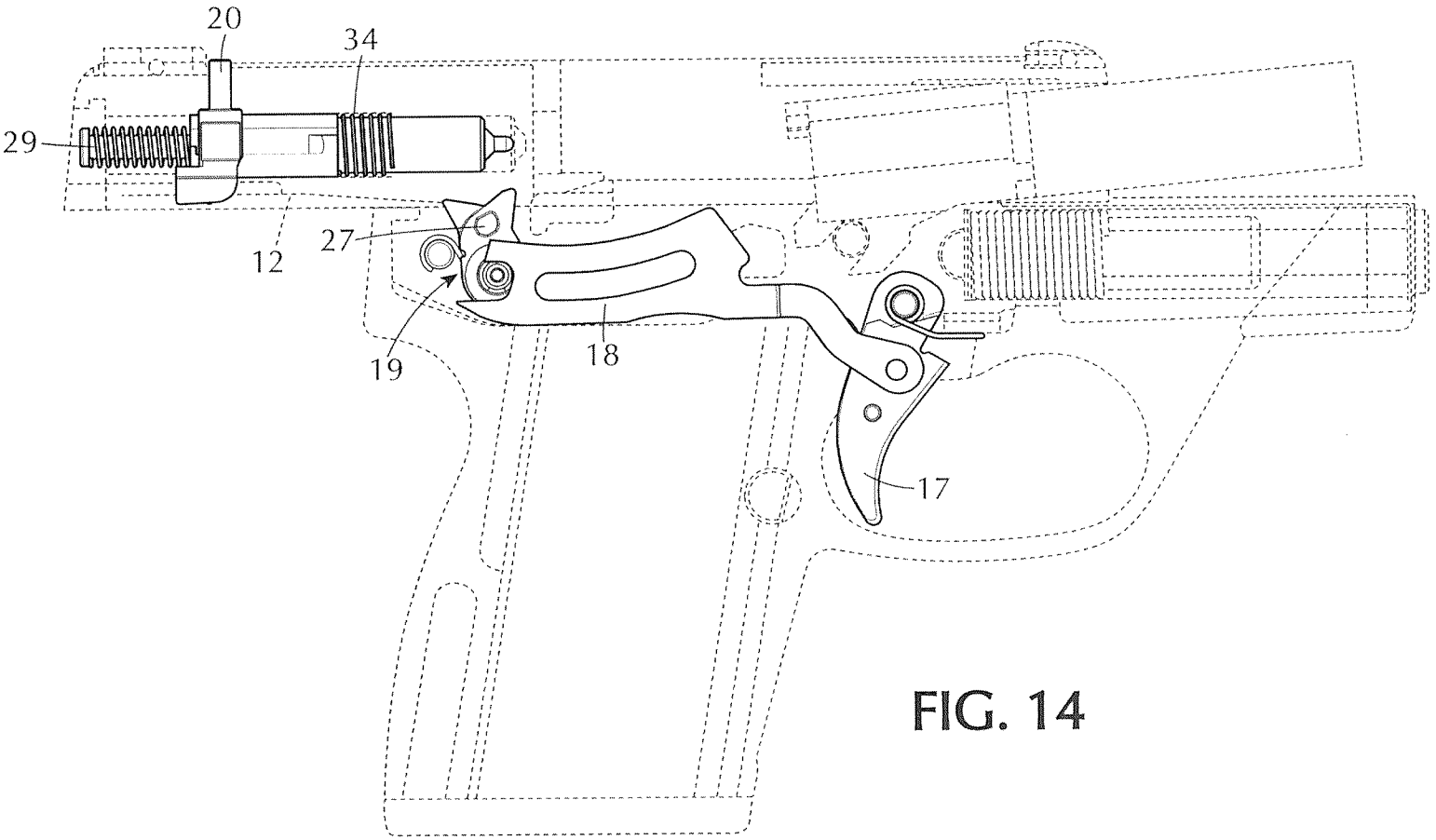
FIG. 14 is a perspective view of the elements of the cocking lever sub-assembly at "end of recoil.
Figure 15:
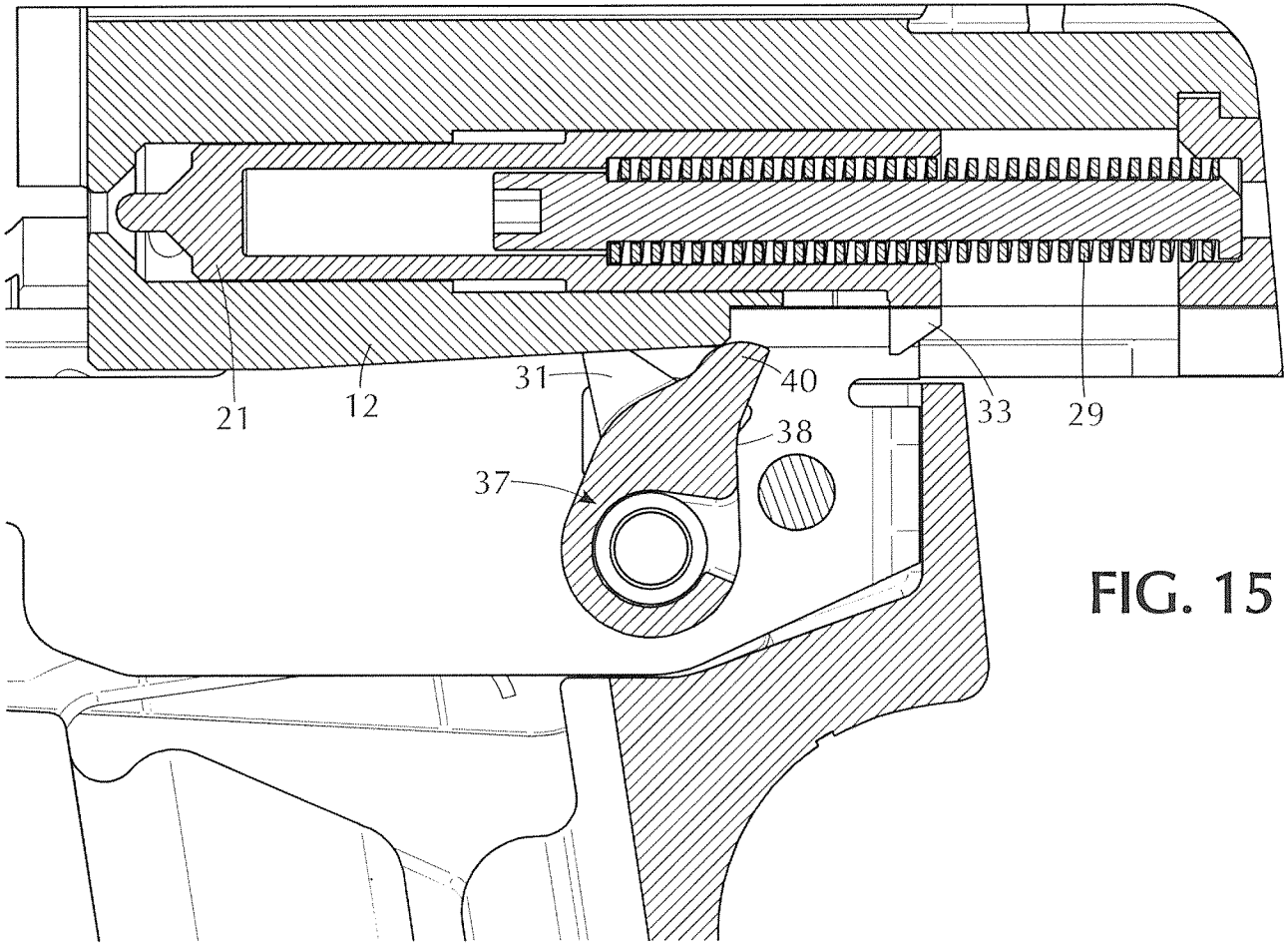
" and FIG. 15 is a cross section showing engagement of cocking lever with slide during recoil.

The new cocking/de-cocking subassembly operates as follows: the trigger bar 18 is pushed rearward by squeezing the trigger 17 (after releasing trigger lock 43 pivotably attached through pivot 52 to the trigger 17) and, after a short pre-travel, the trigger bar nose 28 contacts the cocking lever lug 27 having a faceted surface, which projects laterally from the receiver 11 through the small aperture 53 formed therein. After contact has been established between the trigger bar nose 28 and the surface of the cocking lever lug 27, the trigger bar cammingly rotates cocking lever 19 counterclockwise with lobe surface 38 engaging striker lug 33 to move the striker 21 rearward until complete armament of the striker spring 29 by full compression is achieved (FIGS. 10, 11). Limitation of the vertical travel of the trigger bar 18 is provided through the front notch surface 30 of the trigger bar, engaging the de-cocking pin 22. FIG. 2 illustrates the mechanism at striker release, at the end of the armament travel, with the trigger bar still in contact with cocking lever through lug 27. From this full armament condition, the striker 21, biased by the fully compressed spring 29, fires the gun by forward movement until impact of striker pin 16 with the loaded ammunition and full indentation of the cartridge primer. Importantly, during armament and firing, the striker safety block 20 is elevated, out of the striker path, by lobe 31 by the cocking lever.

Figure 9:
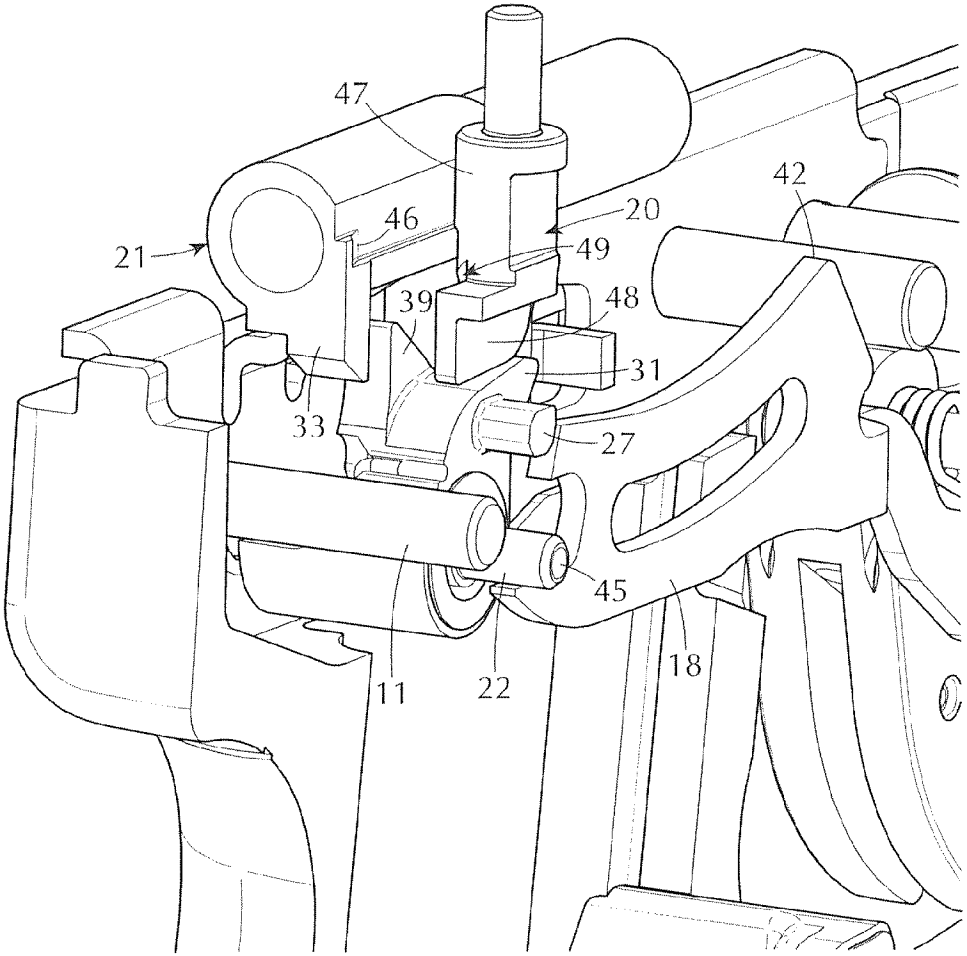
FIG. 9 is a perspective view of the elements of the cocking lever sub-assembly at "pre-cock;"

As shown in FIG. 9, the striker 21 includes a stop surface or step 46 which will block forward travel of the striker by surface 47 of the safety block 20 when it is in its "down" position. However, when the bottom 48 of the safety block is engaged by right lobe 31, it will be cammed upwardly to align passageway 49 with the step 46. When in the elevated position, the passageway will unblock the step 46 to permit the striker to make its forward movement during firing. In the elevated position, indicator pin 54 of the block 20 projects through opening 55 in the slide to provide visual indication that the safety block is elevated and the pistol is in armament phase.

After firing through the explosion of the gun powder, recoil of slide 12 commences and contact between the trigger bar and lever lug 27 is disengaged by the action of camming notch 41 in the slide 12 engaging the trigger bar peak 32 to push the trigger bar down to "disconnection" (see trigger bar dashed line position in FIG. 2). In the new mechanism, the trigger bar 18 is pivotably hinged by trigger bar pivot 51 to the trigger 17 below the trigger rotation axis defined by the trigger pin 50. When the trigger is pulled, the trigger bar 18 moves backward. The camming notch 41 in the slide 12 allows such backward movement with no disconnection until completion of the armament. Because of such design, disconnection of the trigger bar operated by the slide is actuated when the slide is even slightly out of battery position, and the ammunition not completely chambered. Disconnection of the trigger bar allows the cocking lever lobe 38 to return to vertical position as the slide engages arcuate lobe surface 40, and upon return of the slide forward to battery, intercepting striker lug 33 to pre-cock the striker.

Trigger pull release, well after the pistol has fired, returns the trigger bar to the initial position, upwardly biased by a proper spring acting between the frame and the bar (not shown), to an "at rest" position to repeat the gun cycle.

The functioning of the de-cocking assembly is reliable and safe. It ensures the highest safety condition in the event the slide is, even to a minimum extent, out of battery. Safety against undesired movements of trigger and trigger bar upon dropping of the pistol is provided by a very simple safety lever incorporated in the trigger. The striker, with the exception of only the instant of firing (primer's indentation) is constantly biased rearwardly by the striker return spring 34 and, in conjunction with the special configuration of the main striker spring 29, which is confined, at pre-load, inside the striker spring holder 35, prevented from any dangerous exposure out of the breech face.

The illustrated mechanism configuration allows the de-cocking of the cocking lever in a very simple and effective manner by simply laterally displacing the cocking lever on the de-cocking pin 22.

It will be apparent that the cocking lever assembly, with a minimum number of parts, serves multiple purposes. The de-cocking pin 22, in addition to serving as the support for cocking lever 19 and cocking lever spring 23, functions as a limited stop for the trigger bar cam surface 30 and, most importantly, through concave end 25 (FIG. 4), can be laterally moved to de-cock the gun. The cocking lever spring 23 functions as return spring both at firing (torsion mode) and at de-cocking (compression mode), furthermore, being constrained, one end, in a groove of receiver pin (FIGS. 1 and 2), provides the additional feature of keeping the receiver pin 36 in place. The cocking lever 19 itself multi-functions through rotation to cock the striker by the left lobe 38; to control the striker safety block 20 by the right lobe 31; and by simple translation of pin 22 to effect de-cocking.

In review, the mechanism is shown at pre-cock in FIG. 1 with the striker 21 abutting the cocking lever 19 through faceted lug 33, with striker spring 29 partially compressed by the forward pushing slide. The striker safety block 20 is down and engaged with the striker, protecting the pistol from any unwanted discharge of the striker due to accidental drops or rough handling. The trigger bar 18, starting from the rest position shown in FIG. 1, is moved back by the trigger so that bar nose surface 30 contacts cocking lever lug 27, turning the cocking lever counterclockwise until the striker release condition is achieved (FIG. 2).

As shown in FIG. 2, the striker 21 is free to move forward, biased by its own spring 29 at full compression, with the striker safety block 20 elevated out of the striker path, by the counterclockwise rotation of the right lobe 31 of the cocking lever. After firing by the indentation of the primer by striker pin 16 and the consequent explosion of the powder, the peak 32 of the trigger bar, at rest inside the camming notch 41 of the slide (shown in dotted line, FIG. 1), is immediately pushed down by the recoil of the slide to effect trigger bar disconnection from its engagement with cocking lever lug 27 (dashed line position, FIG. 2). The trigger bar at this stage is down "at disconnection." leaving the cocking lever 19 free to return to vertical position, ready, on the slide return of the battery to catch the striker 21 again. The slide 12, in its travel forward, ensures that the striker 21 will always be caught by the surface 38 of the cocking lever lobe 37 and that the striker spring 29 is pre-cocked under the thrust of the slide recoil spring 34 working against it.

The only way to disassemble the slide 12 from the frame 10, making it move forward, is disengaging the striker 21 from the cocking lever 19. In order to avoid a dangerous "dry firing" operation utilized in earlier striker fired weapons, the multiple function cocking lever mechanism of the present invention provides simple de-cocking for disassembly which is simple to perform and which is totally safe.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. A cocking/de-cocking subassembly for a semi-automatic striker pin-fired pistol having a frame in which a receiver is mounted, a reciprocating striker pin, and a reciprocating slide, comprising: (a) a trigger bar connected to and actuatable by a pivotable trigger; (b) a striker mounting said striker pin and selectively movable between pre-cocked position, a fully-cocked position and firing position; (c) a multipurpose cocking lever associated with said trigger bar and said striker; (d) a blocking member movable downwardly into and upwardly out of blocking engagement with said striker; (e) a cocking lever pin supporting said cocking lever for rotation; (f) a spring engaging said cocking lever and said cocking lever pin and providing rotational biasing force to said lever and translational biasing force to said cocking lever pin; (g) multiple camming surfaces on said cocking lever adapted to engage selectively said blocking member and said striker and said trigger bar, whereby rearward movement of said trigger bar upon trigger pivoting rotates said cocking lever to elevate said blocking member to free said striker for forward movement; (h) said cocking lever pin and said cocking lever being selectively laterally movable within the receiver to a position in which movement of the striker is blocked thereby de-cocking the striker.

2. The cocking/de-cocking subassembly of claim 1, in which (a) said cocking lever pin has a free end exposed at a side portion of the frame, whereby said pin may be laterally displaced by an externally applied force.

3. The cocking/de-cocking subassembly of claim 1, in which (a) the trigger moves the trigger bar rearward against a lug formed on the cocking lever; (b) said lug projecting out of a small aperture formed in the receiver, whereby the aperture provides a forward limit of cocking lever rotation.

4. The cocking/de-cocking subassembly of claim 3, in which (a) the trigger bar has a flat nose portion; (b) the lug has a faceted portion; (c) the flat nose engages the faceted portion.

5. The cocking/de-cocking subassembly of claim 1, in which (a) the trigger bar has a control cam surface engaged by the cocking lever pin to limit vertical travel of the trigger bar.

* * * * *